US005614782A

United States Patent [19]

Kim

[11] Patent Number: 5,614,782

[45] Date of Patent: Mar. 25, 1997

[54] DEFLECTION YOKE AND VERTICAL DEFLECTION COIL WINDING METHOD THEREOF

[75] Inventor: Hoo-deuk Kim, Pusan-city, Rep. of Korea

[73] Assignee: Samsung Display Devices Co., Ltd., Kyungki-do, Rep. of Korea

[21] Appl. No.: 463,443

[22] Filed: Jun. 5, 1995

[30] Foreign Application Priority Data

Jun. 24, 1994 [KR] Rep. of Korea ..... 94-14662

[51] Int. Cl.[6] ..... H01J 29/70; H01H 1/00; H01H 5/00

[52] U.S. Cl. ..... 313/440; 335/213

[58] Field of Search ..... 313/440; 335/210, 335/212, 213, 222, 246, 250, 296, 299; 348/829

[56] References Cited

U.S. PATENT DOCUMENTS 5,373,274 12/1994 Belica et al. ..... 313/440

*Primary Examiner*—Sandra L. O'Shea
*Assistant Examiner*—Mark Haynes

[57] ABSTRACT

The vertical deflection coil of a deflection yoke is wound by repeating the process that a main winding is realized by wire wound from the one end to the central portion of each core, wire which returns back at once from the central portion to the other end of the core, is wound along the outer circumferential surface of the core. The main winding is realized by the wire wound from the other end to the central portion of the core, and the wire that returns back at once from the central portion to the one end is wound along the outer circumferential surface of the core. Therefore, the distortion of a vertical deflection magnetic field is prevented.

4 Claims, 7 Drawing Sheets

DEFLECTION YOKE AND VERTICAL DEFLECTION COIL WINDING METHOD THEREOF

BACKGROUND OF THE INVENTION

The present invention relates to a deflection yoke for a cathode-ray tube and a vertical deflection coil winding method of the deflection yoke, and more particularly to the winding of the vertical deflection coil mounted on the cone portion of the cathode-ray tube, for deflecting an electron beam emitted from an electron gun.

As shown in FIG. 1, a cathode-ray tube (CRT) 1 includes a panel 3 on the inside surface of which a fluorescent film 2 is formed, an electron gun 4 housed within the neck portion of the CRT, and a deflection yoke 5 established on a funnel 6 which is coupled to panel 3. An electron beam is selectively deflected by means of deflection yoke 5 according to the beam's scanning position against fluorescent film 2. The deflected beam is landed on fluorescent film 2 to form a picture. In CRT 1 constructed as above, in order to properly deflect the electron beam emitted from electron gun 4 mounted on the neck portion of funnel 6, the horizontal deflection coil of deflection yoke 5 needs to form a pincushion-shaped deflection magnetic field, and the vertical deflection coil of deflection yoke 5 needs a barrel-shaped deflection magnetic field. One embodiment of the deflection yoke is shown in FIG. 2.

The deflection yoke 10 includes a cone-shaped separator 11, a horizontal deflection coil 12 established on the inner circumferential surface of separator 11, a core 13 established on the outer circumferential surface of separator 11, and a vertical deflection coil 14 wound on core 13.

In deflection yoke 10 constructed as above, since the distribution of the pincushion-shaped magnetic field formed by means of vertical deflection coil 14 according to the winding method of the coil wound on core 13 is different from the distribution of the barrel-shaped magnetic field formed by means of vertical deflection coil 14 according to the winding method of horizontal deflection coil 12, the distortion of the magnetic field due to the deflection of the electron beam is generated. Numerous coil winding methods have been proposed in order to compensate for this deflection distortion.

In one such vertical deflection coil winding method, after one winding layer is made by winding wire from one end of the core to the other end thereof, and returning back to the one end of the core, the next wire winding layer is formed by repeating the above process. In such a winding method, the winding of wire is returned to the start point of the first winding by a "shootback" method in which the wire follows a straight path along the outer circumferential surface of the core, or by a "spiralback" method in which the wire follows an annular path the interval of which becomes enlarged gradually on the outside circumferential of the core.

If the shootback method is used, the wire slips in the neighborhood of the vertical end of a winding layer and the position of the wire may deviate from the winding layer due to the sudden change of a wire position. To solve such a problem, adhesive means is needed to maintain the original position of the wire.

Since the part of return winding is arranged along the inner side of the core, an effective region, the spiral winding method introduces an unnecessary high frequency to the deflection magnetic field and generates an undesirable ringing phenomenon. Namely, an indirect magnetic field which adversely affects the function of the deflection yoke is generated. Also, when the coil wound on the core returns back from one side to the other side of the core, the wire may be twisted.

In the spiralback winding method, as shown in FIG. 3, a main winding 22 is wound repeatedly from side to side in order to minimize the indirect magnetic field, and a wire 23 returns back at once from one side of core 21 to the other side thereof was developed.

However, such a winding method has a drawback that a magnetic field distribution by main winding 22 wound from the left end to the right end of the core does not generate the distortion of the magnetic field, but wire 23 returning back to the start point at once generates the distortion of the magnetic field.

FIG. 4 shows another embodiment among the winding method of the vertical deflection coil. Here, a fixing frame 33 on which a plurality of slit 32 which are spaced mutually a predetermined distance on the bottom portion of a core 31, and on which the wire is supported, are formed, is mounted to core 31. A wire 34 forming the coil wound on one quadrant of core 31 is wound clockwise. Then, wire 34 is wound counterclockwise from an adjacent quadrant of the core.

While the deflection yoke on which the coil is wound can reduce physical spreading of the spot of the electron beam landed on a fluorescent surface by the above method, fixing frame 33 needs to be established on the lower portion of the core. This increases the production cost of the deflection yoke and lowers productivity by marking the winding of wire 34 difficult.

SUMMARY OF THE INVENTION

It is an object of the present invention to provide a deflection yoke able to prevent a phenomenon in which a picture is distorted or shaken by a deflected electron beam and a method of winding a vertical deflection coil of the deflection yoke.

To accomplish the above object, a deflection yoke according to the present invention includes: a cone shaped separator; one pair of core established on the outer circumferential surface of the separator, protecting the separator; and a coil wound by repeating the process that a main winding is realized by wire wound from the one end to the central portion of each core, the wire which returns back at once from the central portion to the other end of the core, is wound along the outer circumferential surface of the core, the main winding is realized by the wire wound from the other end to the central portion of the core, and the wire that returns back at once from the central portion to the one end of the core, is wound along the outer circumferential surface of the core.

In the deflection yoke of the present invention, it is preferable that the number of return windings located at both sides centered on the central portion of the core are the same.

To accomplish the above object, there is provided a vertical deflection coil winding method of the deflection yoke winding the wire on the core includes: a first step of dividing the core into a first and a second regions centered on a central portion of the core, and winding from the one end of the core to the central portion of the core; a second step of winding at once the wire located at the central portion of the core from the central portion of the core to the other end of the core along the outer circumferential surface; a third step of continuously winding the wire located at the other end of the core to the central portion of the core; and a fourth step of winding at once the wire located at the central portion of the core to the one end of the core along the outer circumferential surface.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
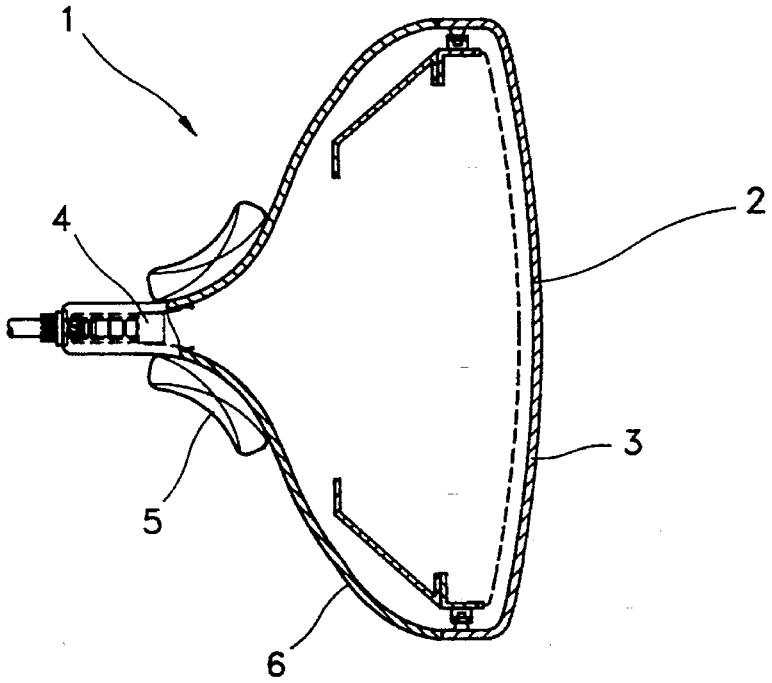
FIG. 1 is a perspective view of a conventional deflection yoke.
Figure 2:
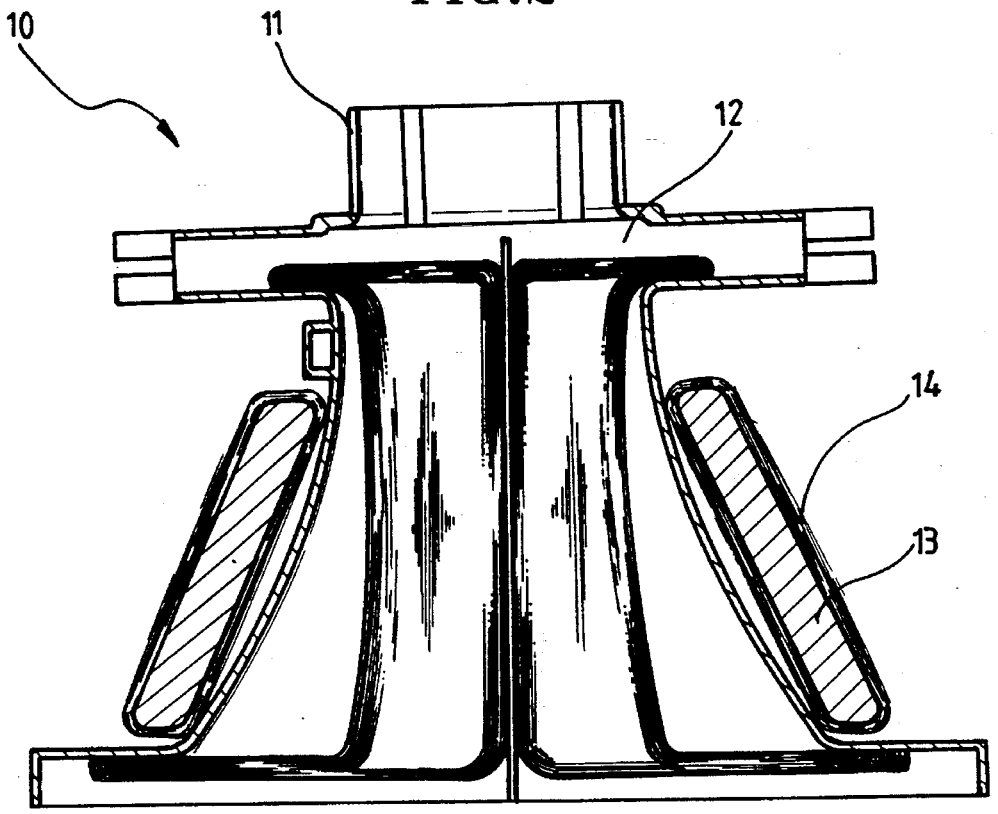
FIG. 2 is a cross sectional view of a conventional deflection yoke.
Figure 3:
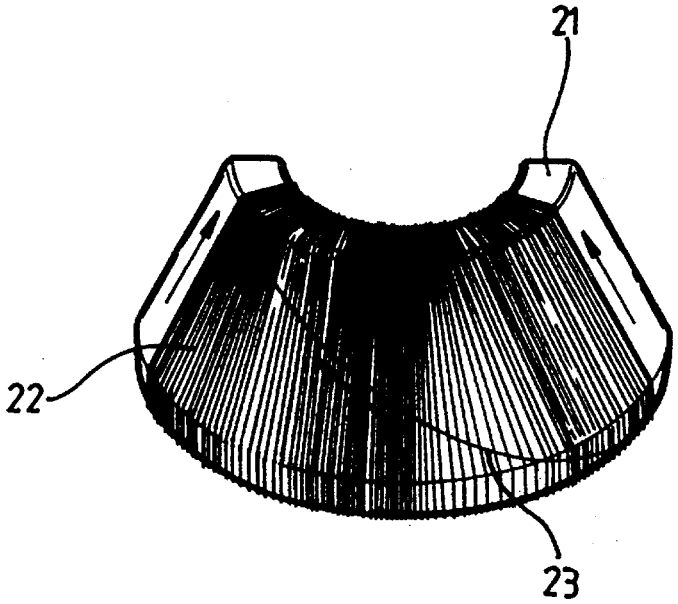
FIG. 3 is a perspective view showing the state that the coil is wound on the core.
Figure 4:
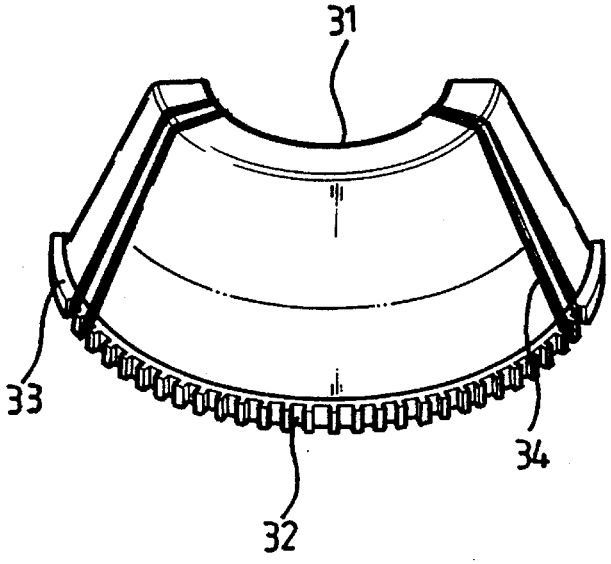
FIG. 4 is a perspective view of one example in which the coil is wound on the core.
Figure 5:
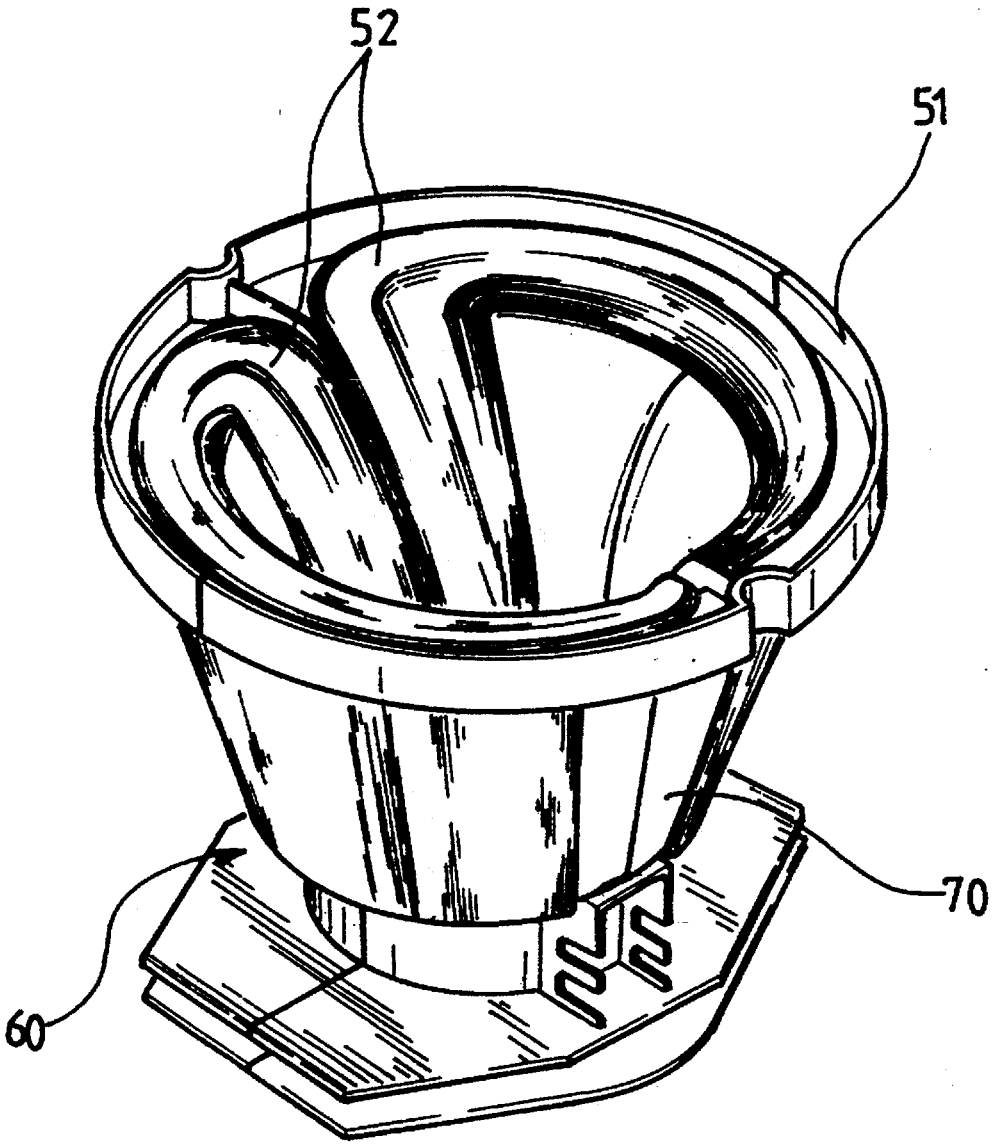
FIG. 5 is a perspective view of a deflection yoke according to the present invention.

A deflection yoke according to the present invention is mounted to the cone portion of a cathode-ray tube and emits a hot electron. One embodiment of the present invention is shown in FIG. 5.

The deflection yoke includes a cone-shaped separator 51, one pair of horizontal deflection coils 52 established on the inner circumferential surface of separator 51, and a vertical deflection coil 60 established on the outer circumferential surface of separator 51.

Figure 6:
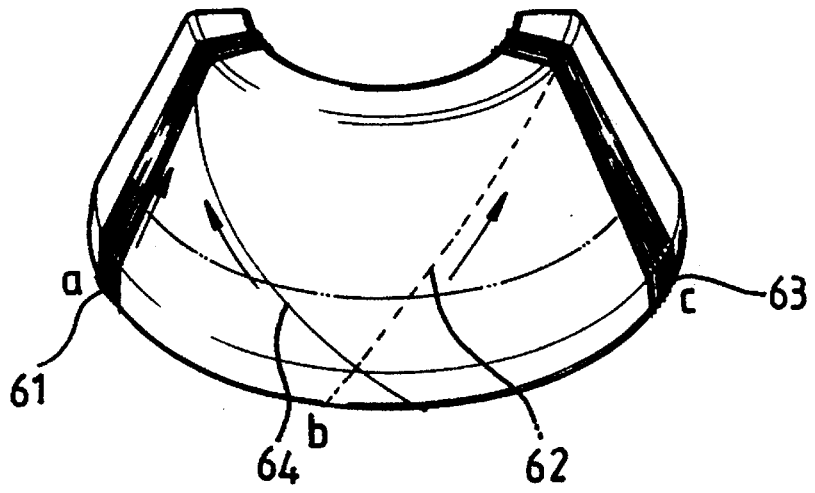
FIG. 6 is a perspective view showing the state that a vertical deflection coil is wound on the core of the deflection yoke according to the present invention.

Vertical deflection coil 60 is wound on a core 70 fixed to the outer circumferential surface of separator 51 in a predetermined pattern. As shown in FIG. 6, vertical deflection coil 60 formed by winding wire on core 70 includes: a first main winding portion 61 where the wire is wound from the left end of core 70 to the central portion of the core; a first return winding portion 62 where the wire returns back at once to a right end along an outer circumferential surface from the central portion of core 70; a second main winding portion 63 where the wire is wound from the right end to the central portion of the core; and a second return winding portion 64 where the wire returns back at once to the left end along the outer circumferential surface of core 70 from the central portion of core 70. First and second main winding portions 61 and 63 and first and second return winding portions 62 and 64 can be formed in a layered structure by repeatedly winding the wire on the circumferential surface of core 70. It is preferable that first and second return winding portions 62 and 64 centered on the central portion of core 70 and wound on each side have the same number of windings. It is also preferable that first and second return winding portion 62 and 64 are located at the outer circumferential surface so as not to be located along the inner side, an effective region, of the core.

Figure 7:
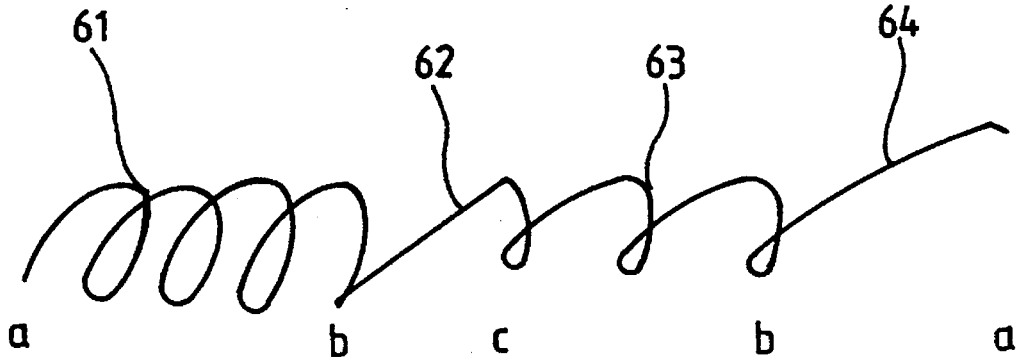
FIG. 7 is a schematic view showing the state that the coil is wound on the core according to the present invention.

As shown in FIGS. 6 and 7, the winding method of a vertical deflection coil winding the vertical deflection coil of the deflection yoke according to the present invention on core 70 established on the outer circumferential surface of separator 51 includes: a first step of dividing the core centered on the central portion of the core into a left and a right side (the left side and the right side of the core shown in the drawing), winding the wire from the left end (point a) to the central portion (point b) of core 70; a second step that the wire returns back at once to the other end, the right end (point c), of core 70 along the outer circumferential surface from the central portion of core 70; a third step of winding continuously the wire wound on the right end of core 70 from the right end (point c) to the central portion (point b) of core 70; a fourth step that the wire located at the central portion of core 70 returns back at once to the left end (point a) of core 70; and a fifth step of winding the wire from the left end (point a) of core 70 to the central portion (point b). In a method winding the vertical deflection coil, it is preferable that the main winding and the return winding where the wire is wound in the left and the right side of core 70 respectively have the same number of the winding.

The deflection yoke according to the present invention constructed as above and the operation of the vertical deflection coil winding method of the deflection yoke will be explained as follows.

Figure 8:
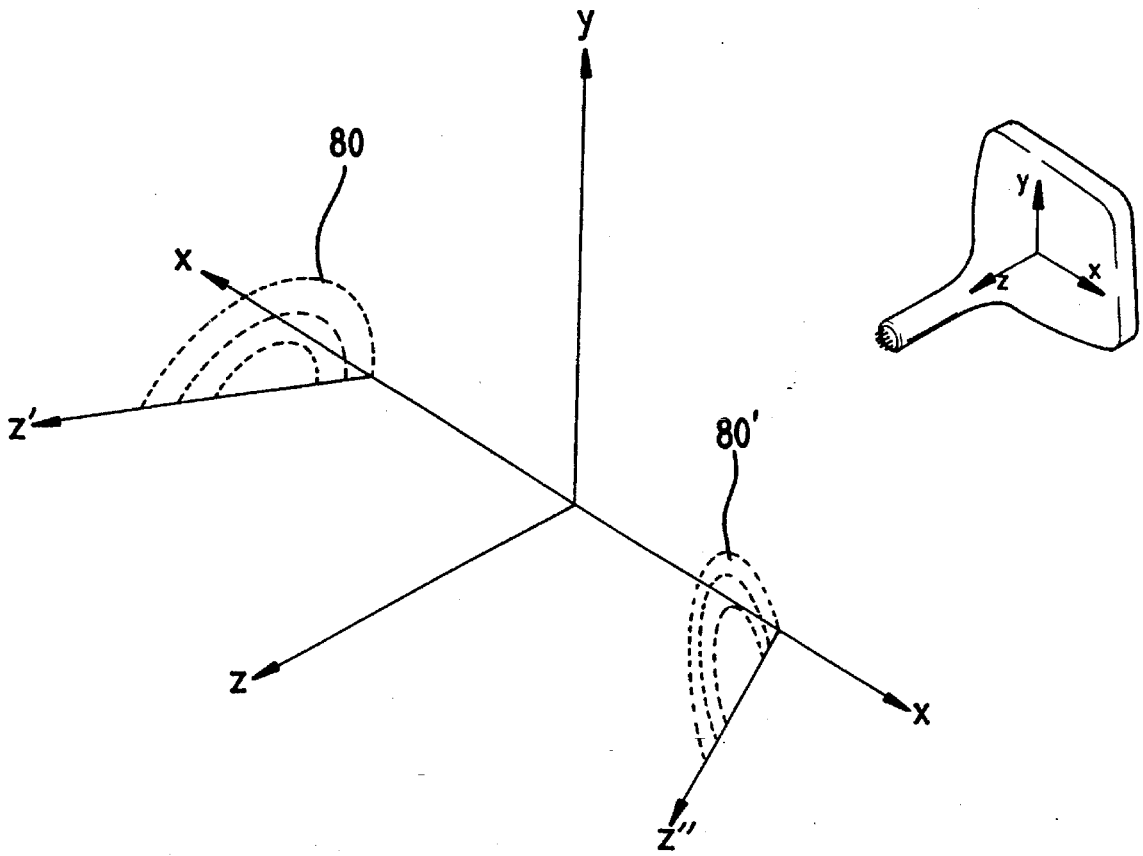
FIG. 8 is a schematic view showing the distribution of the magnetic field formed by a first and a second return winding.
Figure 9:
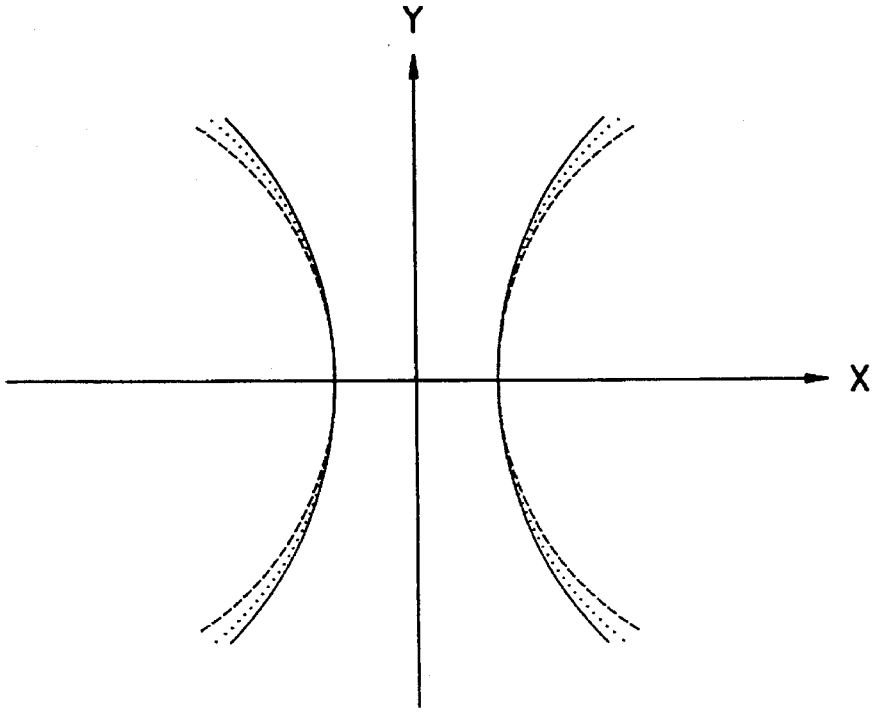
FIG. 9 is a drawing showing the distorted state of the deflection magnetic field by the first and the second return winding.

First, if a predetermined electrical potential is supplied to vertical deflection coil 60 of the deflection yoke according to the present invention, the magnetic field capable of deflecting an electron beam emitted from an electron gun is formed. As shown in FIG. 8, if the horizontal direction of the screen surface of a cathode-ray tube is regarded as an X axis, the vertical direction of the screen surface is regarded as a Y axis, and the direction from the screen surface toward the electron gun is regarded as a Z axis, the distribution of the magnetic field formed by first and second main winding portion 61 and 63 where the wire is wound on both sides centered on the central portion of the core, is formed properly without the distortion of the magnetic field with regard to the Z axis. Namely, the distribution of the magnetic field centered on an electron beam emitted from the electron gun is formed symmetrically. Since the distribution of the vertical magnetic field formed by first and second return winding portion 62 and 64 is inclined so that both sides centered on the central portion of core 70 are symmetrical, the magnetic field is distorted in mutually opposite directions. Namely, the axis (Z') of the magnetic distribution formed on first return winding portion 62 wound so as to be inclined in the right side centered on the central portion of core 70 and the axis (Z") of the magnetic field distribution (80') formed by second return winding portion 64 wound so as to be inclined in the right side of core 70 are offset with a predetermined degree respectively with regard to the Z axis, the offset directions are opposite each other and are symmetrical with regard to the Z axis. Accordingly, the distorted states of the vertical deflection magnetic field formed on first and second main winding portion 61 and 63 and first and second return winding portion 62 and 64 are symmetrical with regard to the Y axis as shown in FIG. 9.

Figure 10:
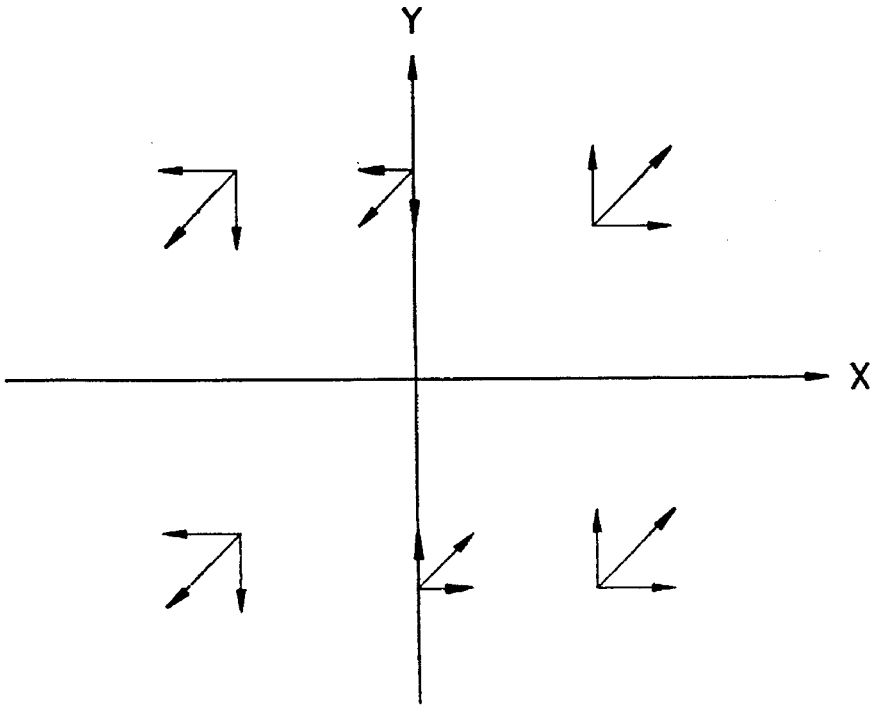
FIG. 10 is a drawing showing the deflected state of an electron beam by the conventional deflection yoke.
Figure 11:
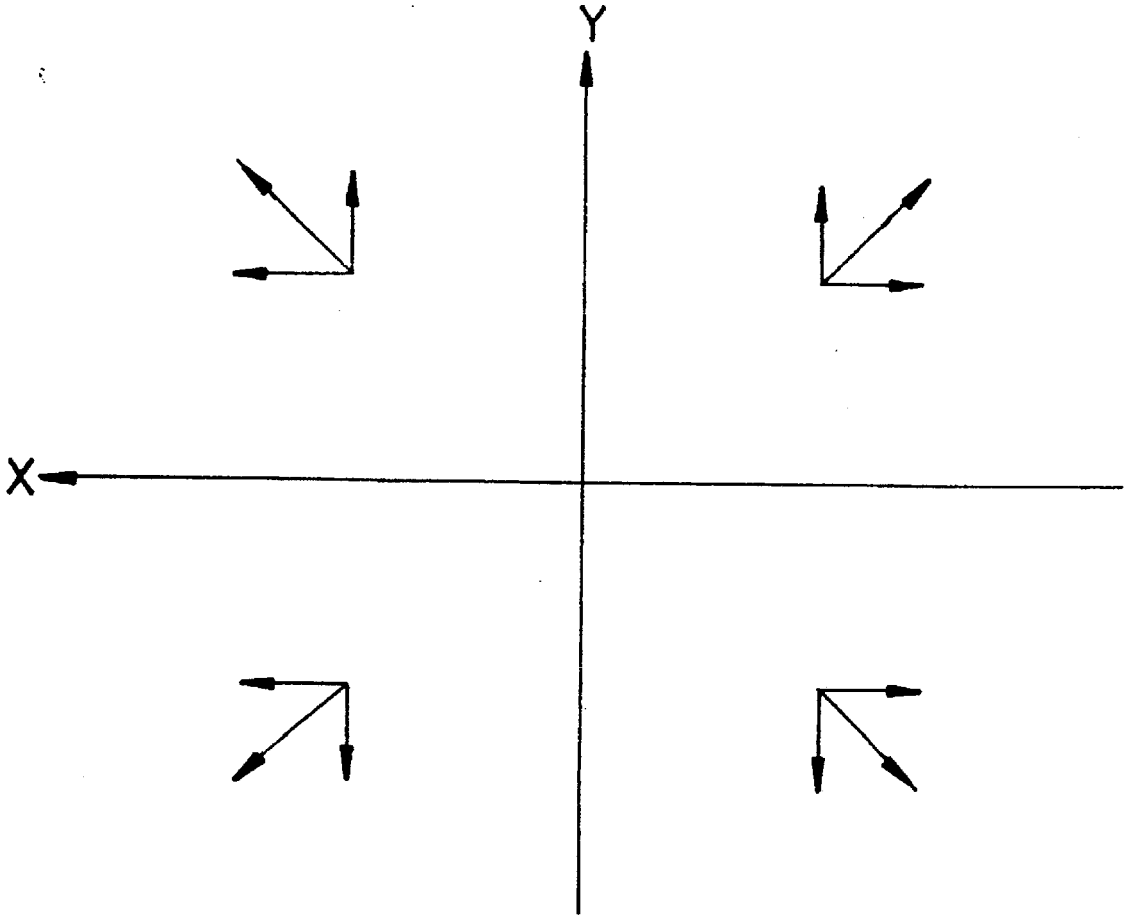
FIG. 11 is a drawing showing the state that an electron beam is deflected by the deflection yoke according to the present invention.

Accordingly, it is possible to reduce the influence of an interference magnetic field causing a bad influence to the function of the deflection yoke. To explain further in detail, in case that the wire is wound in only one direction as the art on the core of the return winding portion as shown in FIG. 10, since the electron beam landed on a fluorescent film by the return winding and the main winding, receives the deflection force as much as the quantity of a vector summing the magnetic field by the main winding and the distorted magnetic field by the return winding, the electron beam is rotated and a picture is distorted. However, in the deflection yoke according to the present invention, since first and second return winding portion 62 and 64 centered on the central portion of core 70 are arranged symmetrically and established to be inclined in the opposite directions each other, a mutual interference to the deflection magnetic field formed by first and second return winding portion 62 and 64 is canceled and the deflected electron beam is not rotated resulting in preventing the distortion of the picture.

Since the wire is wound on both sides centered on the central portion of the core symmetrically by the vertical deflection coil winding method of the deflection yoke according to the present invention, the distribution of the vertical deflection magnetic field for deflecting the electron beam-can be uniform. Since first and second return winding portion 62 and 64 are located at the outer circumferential surface of the core and not located at the effective region, the inner side, of the core, unnecessary high frequency is not introduced to the core so that it is possible to prevent the generation of undesirable ringing phenomenon to a deflection current.

As explained hereinabove, the deflection yoke and the vertical deflection coil winding method of the deflection yoke according to the present invention can reduce the deflection force acting unsymmetrically to the deflected electron beam.

The deflection yoke and the vertical deflection coil winding method of the deflection yoke can be used in a cathode-ray tube of 14 inches, 21 inches, 25 inches or greater.

What is claimed is:

1. A deflection yoke comprising:

a cone-shaped separator;

one pair of cores established on the outer circumferential surface of said separator, protecting said separator, each core having a first end, a central portion, and a second end; and a pair of coils, each coil being formed by a wire wound around one of said coils, wherein, the wire of each coil follows a repeating path from the first end around the core to the central portion of the core, from the central portion to the second end of the core along an outer circumferential surface of the core, from the second end around the core to the central portion of the core, and from the central portion to the first end along the outer circumferential surface of the core.

2. A deflection yoke according to claim 1, wherein the number of return windings wound along the outer circumferential surface of each core and located at both sides centered on the central portion of each core, are the same.

3. A method of forming a vertical deflection coil winding on a core having a first end, a central portion, and a second end, comprising the steps of:

dividing the core into first and second regions centered on the central portion of the core, winding a wire vertically and repeatedly around the core from the first end of the core to the central portion of the core;

winding the wire located at the central portion of the core directly from the central portion of the core to the second end of the core along an outer circumferential surface;

winding the wire vertically and repeatedly around the core from the second end to the central portion of the core; and winding the wire located at the central portion of the core directly to the first end of the core along the outer circumferential surface.

4. A vertical deflection coil winding method according to claim 3, wherein the number of return windings wound along the outer circumferential surface of each core and located at both sides centered on the central portion of each core, are the same.

* * * * *